US009809346B2

(12) United States Patent
Valencia

(10) Patent No.: US 9,809,346 B2
(45) Date of Patent: Nov. 7, 2017

(54) FOLDING CARTON WITH RETRACTABLE PANEL

(71) Applicant: WestRock Shared Services, LLC, Norcross, GA (US)

(72) Inventor: John Valencia, Johns Creek, GA (US)

(73) Assignee: WestRock Shared Services, LLC, Norcross, GA (US)

( * ) Notice: Subject to any disclaimer, the term of this patent is extended or adjusted under 35 U.S.C. 154(b) by 109 days.

(21) Appl. No.: 13/832,716

(22) Filed: Mar. 15, 2013

(65) Prior Publication Data

US 2013/0277420 A1 Oct. 24, 2013

Related U.S. Application Data

(60) Provisional application No. 61/637,494, filed on Apr. 24, 2012.

(51) Int. Cl.
*B65D 5/42* (2006.01)

(52) U.S. Cl.
CPC ..... *B65D 5/42* (2013.01); *B65D 5/427* (2013.01); *B65D 5/4208* (2013.01); *B65D 5/4237* (2013.01)

(58) Field of Classification Search
CPC .... B65D 5/5035; B65D 5/522; B65D 5/5266; B65D 69/00; B65D 5/4208; B65D 5/4237; B65D 5/4216
USPC .... 206/768, 767, 736, 232, 534, 815, 459.1, 206/459.5, 831, 45.25, 806, 467, 469; 229/32, 120.08, 117.18; 116/321
See application file for complete search history.

(56) References Cited

U.S. PATENT DOCUMENTS 1,150,852 A * 8/1915 Davidson ..... 229/152
2,033,299 A * 3/1936 Reichel ..... 206/744
2,108,278 A * 2/1938 Webber ..... 206/758
2,467,660 A * 4/1949 Coughlin ..... 206/246
3,099,381 A * 7/1963 Meyers ..... 206/459.5
3,380,575 A * 4/1968 Hennessey ..... 206/45.25
3,567,014 A * 3/1971 Feigelman ..... 206/767
3,674,133 A * 7/1972 Locke ..... 206/767
3,946,936 A * 3/1976 Brown ..... B65D 5/4208 206/806
4,197,985 A * 4/1980 Austin ..... 229/220
4,413,730 A * 11/1983 Morse ..... 206/232
4,630,734 A * 12/1986 Severin ..... B65D 5/38 206/102
4,848,582 A 7/1989 Levasseur et al.
4,949,845 A * 8/1990 Dixon ..... B65D 5/4208 206/806
5,341,923 A * 8/1994 Arasim ..... 206/214
5,363,955 A * 11/1994 Fleenor ..... 206/273
5,474,183 A * 12/1995 Warren et al. ..... 206/459.5
(Continued)

*Primary Examiner* — J. Gregory Pickett
*Assistant Examiner* — Gideon Weinerth
(74) *Attorney, Agent, or Firm* — WestRock IP Legal

(57) ABSTRACT

Embodiments of the present invention provide a folding carton designed to accept a retractable panel. The retractable panel may contain written information that should stay with or otherwise connected to the packaging, rather than on a folded leaflet inserted inside the carton that may be displaced. The panel may be pulled from its fully inserted/retracted position (within the carton) out to an extended position, where the panel displays the information. Even in the extended position, however, the panel stays secured with the carton.

7 Claims, 5 Drawing Sheets

(56) References Cited

U.S. PATENT DOCUMENTS 5,718,336 A * 2/1998 Haarlander ..... 206/542
5,860,589 A * 1/1999 Hsu ..... 229/162.3
5,944,177 A * 8/1999 Nemoto ..... B65D 75/366 206/232
6,053,325 A * 4/2000 Yonker et al. ..... 206/736
6,061,938 A * 5/2000 Young ..... 40/490
6,070,719 A * 6/2000 Pollock ..... B42D 15/04 206/232
6,305,597 B1 10/2001 Donegan et al.
6,386,371 B1 * 5/2002 Parsons ..... 206/768
6,393,707 B1 * 5/2002 Maffei ..... 33/1 SD
6,702,108 B2 * 3/2004 Lo Duca ..... 206/232
6,742,652 B1 * 6/2004 Focke et al. ..... 206/268
6,840,437 B2 1/2005 Chen
6,892,876 B1 5/2005 Aubry et al.
6,923,315 B2 * 8/2005 Lo Duca ..... B65D 5/4237 206/232
7,036,254 B1 * 5/2006 Jones et al. ..... 40/495
7,331,451 B2 * 2/2008 Focke et al. ..... 206/264
7,552,820 B2 6/2009 Kohler
7,870,953 B2 * 1/2011 Tanbo et al. ..... 206/268
7,938,257 B2 5/2011 Kohler
8,006,835 B2 * 8/2011 Moore et al. ..... 206/273
8,066,186 B2 * 11/2011 Kidwell ..... 235/462.01
8,104,795 B2 1/2012 Wilen
8,511,462 B2 * 8/2013 Mezzini ..... 206/38
8,910,784 B2 * 12/2014 Moore et al. ..... 206/273
2003/0047482 A1 * 3/2003 Jones et al. ..... 206/534
2003/0173238 A1 * 9/2003 Lo Duca ..... 206/232
2004/0011859 A1 * 1/2004 Lo Duca ..... 229/120.18
2004/0020977 A1 * 2/2004 Lo Duca ..... 229/120.18
2004/0045863 A1 * 3/2004 Rhoades ..... 206/534
2004/0169067 A1 * 9/2004 Chen ..... 229/120.17
2005/0274783 A1 * 12/2005 Maffei ..... 229/220
2007/0199982 A1 * 8/2007 Lo Duca ..... B65D 5/4237 229/120.18

* cited by examiner

FOLDING CARTON WITH RETRACTABLE PANEL

CROSS REFERENCE TO RELATED APPLICATIONS

This application claims the benefit of U.S. Provisional Application Ser. No. 61/637,494, filed Apr. 24, 2012, titled "Folding Carton with Retractable Panel," the entire contents of which are hereby incorporated by reference.

FIELD OF THE INVENTION

Embodiments of the present invention relate generally to a folding carton designed to accept a retractable panel. The retractable panel may contain written information that should stay with or otherwise connected to the packaging, rather than on a folded leaflet inserted inside the carton that may be displaced. The panel may be pulled from its fully inserted/retracted position (within the carton) out to an extended position, where the panel displays the information. Even in the extended position, however, the panel stays secured with the carton.

BACKGROUND

Many consumer products are packaged in small cartons or boxes that do not allow a large space for printing directions for use, ingredient lists, cautionary warnings, legal notices, or any other important communications from the manufacturer. Accordingly, such products are typically packaged with a leaflet with the desired and/or required instructions, materials, or disclosures. These leaflets are often ignored, thrown away, or misplaced. There are other printed materials that may also be desirable to include integrally associated with a carton or package, such as future coupons, recipes, directions for use, reminder cards, business cards, or any other materials. It is thus desirable to provide a unique packaging system that provides a retractable, but retainable, panel that can display additional information.

Some attempts have been made to manufacture cartons with retractable panels. However, in many of these instances, the panels have been made fully removable, such that when the panel is extended, it pulls directly out of the carton. In other instances, the retractable panel has been formed as a hang tag, such that the retailer has the option of either hanging the carton from a display peg (and thus, extending the panel) or stacking the carton without use of the hang tab (and thus, leaving the panel in the retracted position). However, these attempts do not fully meet all customer desires, and accordingly, improvements to cartons with retraceable panels are needed.

BRIEF SUMMARY

Embodiments of the invention described herein provide a folding carton designed to accept a retractable panel, and the retractable panel can either be retracted into the carton body or it can be extended for viewing of information printed on the panel. Even when the panel is pulled from its fully inserted/retracted position (within the carton) out to its extended position, the panel stays secured with the carton. Embodiments also provide a back panel with a hanging feature, which allows the carton to be displayed in various ways.

DETAILED DESCRIPTION

Embodiments of the present invention provide a one-piece folding carton 10 with a retractable panel 12. This retractable panel 12, which is generally formed from the same blank as the rest of the carton, can be used to provide more information about product housed in the carton without adding to the size of the carton. In use, after the carton 10 is formed from the blank and the retractable panel 12 is positioned properly, the retractable panel 12 may be pulled out from the body of the carton to reveal information. Though the panel is pulled from the carton, it is still secured within the carton structure and may be retracted back into the carton 10.

Figure 1:
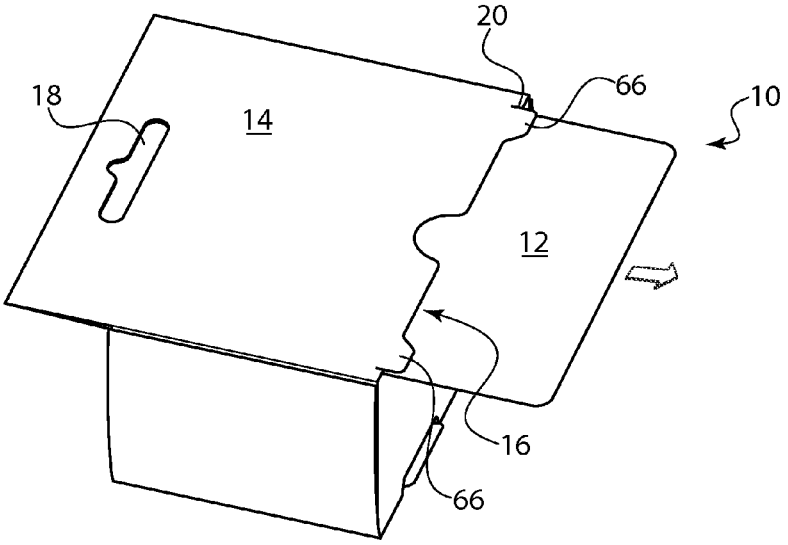
FIG. 1 shows a back perspective view of one embodiment of a carton with a retractable panel in its extended position.
Figure 2:
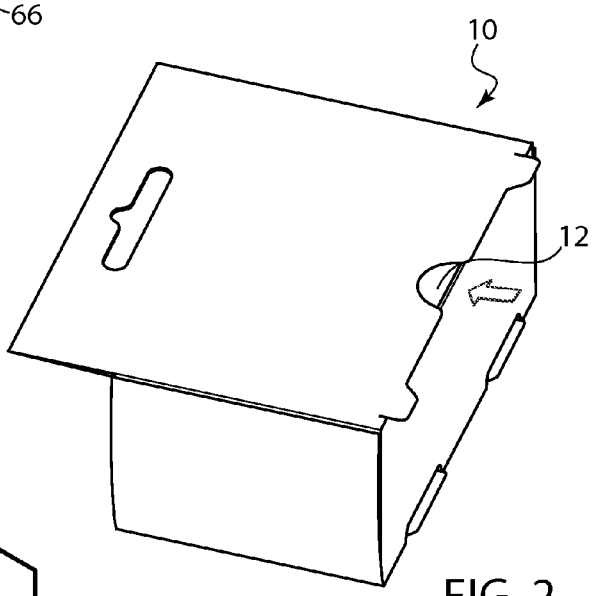
FIG. 2 shows a back perspective view of the carton of FIG. 1 with the retractable panel in its retracted position.
Figure 3:
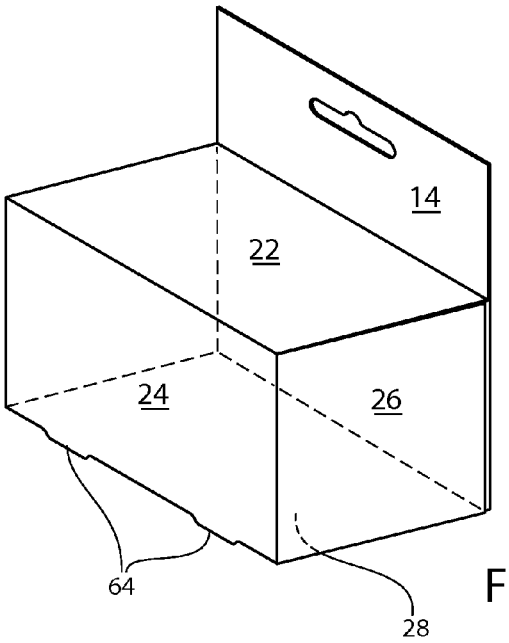
FIG. 3 shows a front perspective view of the carton of FIGS. 1 and 2.

Referring more specifically to FIG. 1, the carton 10 is shown as having a back wall 14 with an opening 16 at the base 20 thereof. The retractable panel 12 extends into and out of the opening 16. The back wall 14 is also shown as having a hanging feature 18, which allows the carton 10 to be hung on a display peg or other store display rack. FIG. 1 shows the retractable panel 12 in its extended position, such that printing or other indicia on the panel 12 can be reviewed. In this embodiment, the panel 12 extends and retracts into the base area 20. (It should be understood that it is possible to modify the carton blank from which carton is made in order to provide a panel 12 that extends from an upper portion of the back wall 14 instead.) FIG. 2 shows an alternate back perspective view of the carton, with the retractable panel 12 in its retracted position. FIG. 3 shows a front view of the carton with the retractable panel 12 in its retracted position. This embodiment shows the carton 10 having a back wall 14, a top portion 22, a front portion 24, two side walls 26, and a bottom portion 28.

Figure 4:
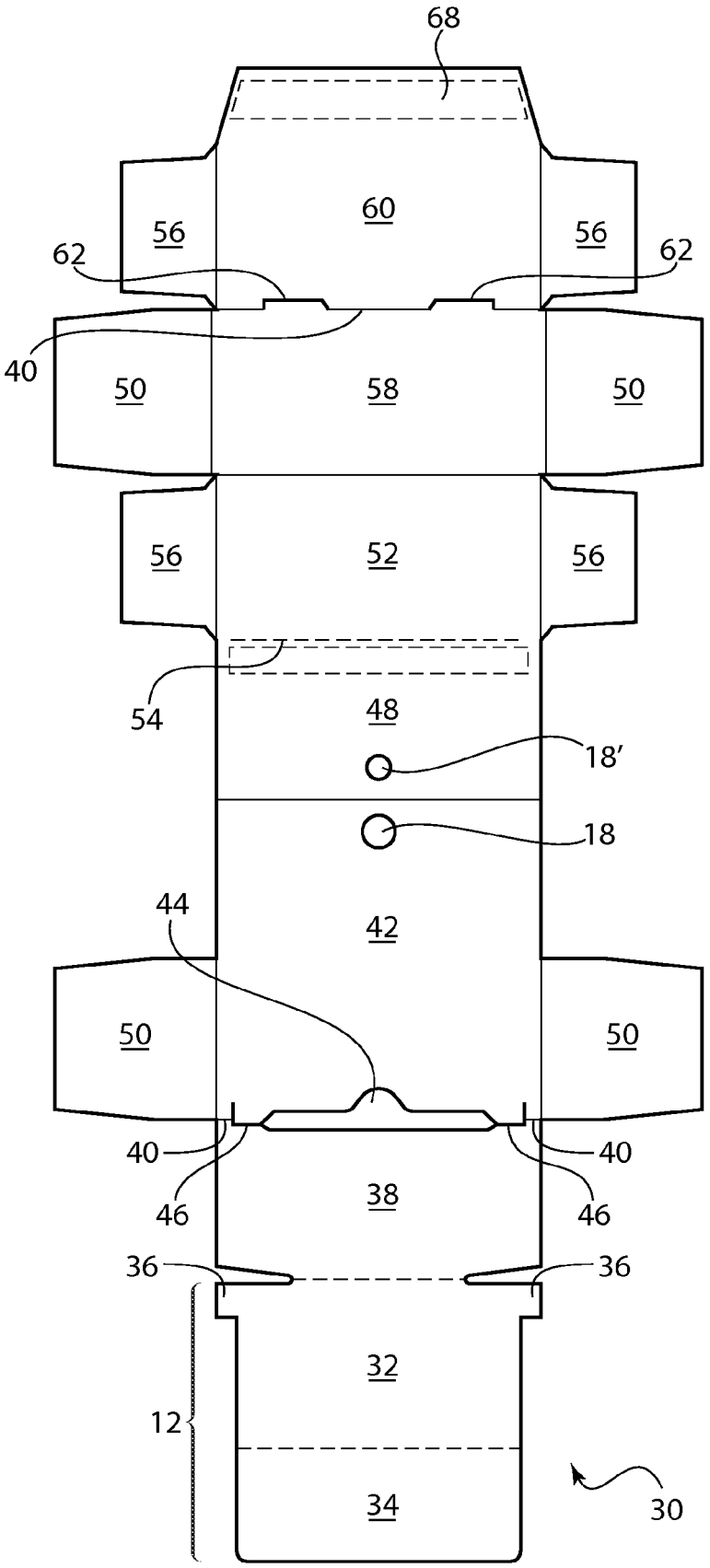
FIG. 4 shows one embodiment of a blank that may be used to create a folding carton with a retractable panel.
Figure 5:
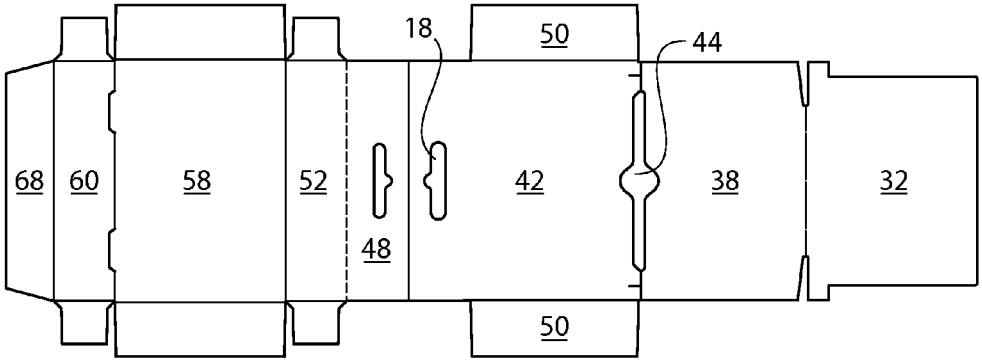
FIG. 5 shows an alternate blank embodiment.
Figure 6:
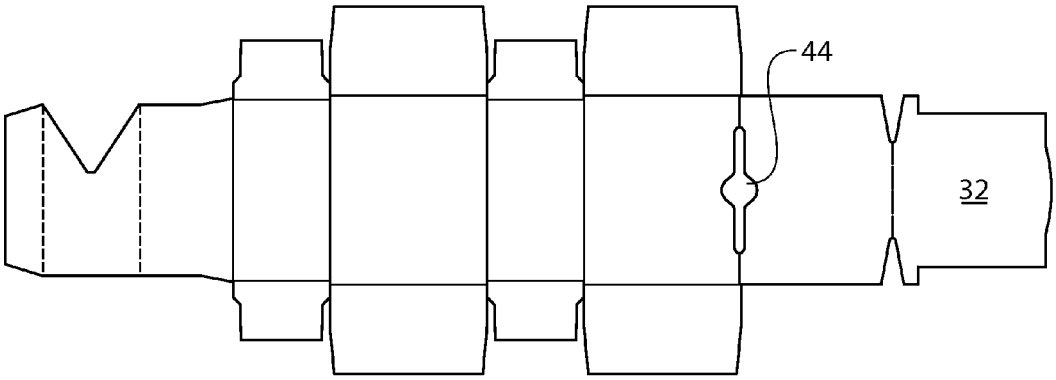
FIG. 6 shows an even further alternate blank embodiment.

Referring now to FIG. 4, the carton 10 is formed of a 30 blank that may be provided as a one-piece blank. The retractable panel 12 may be formed as a part of the blank 30 and simply die-cut to be removed during manufacture or it may be provided as a completely separate item of manufacture. In the blank embodiment shown in FIG. 4, the retractable panel 12 is shown as a part of the blank 30. Retractable panel 12 is shown as being formed from primary panel 32 and secondary panel 34. This embodiment provides the option of expanding the printable space available on the retractable panel 12 once extended, in the event that additional information is to be provided. Primary panel 32 is the primary portion of the retractable panel, and it has shoulder tabs 36 which secure panel 32 in place with respect to the carton. Secondary panel 34 is optional and may be folded out in order to provide additional printing space for the retractable panel 12. (FIGS. 5 and 6 shows primary panel 32 only, without a secondary panel being provided.) During manufacture, the primary retractable panel 32 and the secondary panel 34 may be removed prior to folding the remainder of the bank 30. Variously-sized information panels may be provided by expanding or reducing the size(s) of panels 32, 34. It may also be desirable to add additional folding panels to one or more of panels 32, 34 in order to provide even further printable space. These additional panels may be perforated and removable from the retractable panel 12 piece or they may be connected via score lines that allow easy folding of the panels, but keep all panels secured to one another.

Blank 30 also has a securement flap 38 which is foldably connected via edge score lines 40 to a back panel 42. There is a space 44 between securement flap 38 and back panel 42 (which is what forms the opening 16 through which the retractable panel 12 extends in use). Space 44 may be any shape, but it should generally be wide enough that it can receive the primary panel 32, but provide a stop for shoulder tabs 36. Alternate space 44 shapes are shown in FIGS. 5 and 6. Cut areas 46 may be provided adjacent each side of the space 44, but inward of the score lines 40, in order to provide further space for insertion of the panel 32, 34. The cooperation between the securement flap 38 and the back panel 42 creates a housing of sorts, into which the retractable panel 12 (formed of primary panel 32 and optional panel 34) may be positioned in use.

Back panel 42 is generally the largest panel on the blank 30. Back panel 42 provides the substantial part of back wall 14 of the carton 10. As shown in FIGS. 1-3, as well as in FIG. 4, back panel 42 may have a hanging feature 18, such as a hole that is easily punched out of the panel for hanging use. FIG. 6 also shows a back panel without a hanging feature. Back panel 42 may also have one or more side flap panels 50 secured thereto, which will be described in more detail below.

Figure 7:
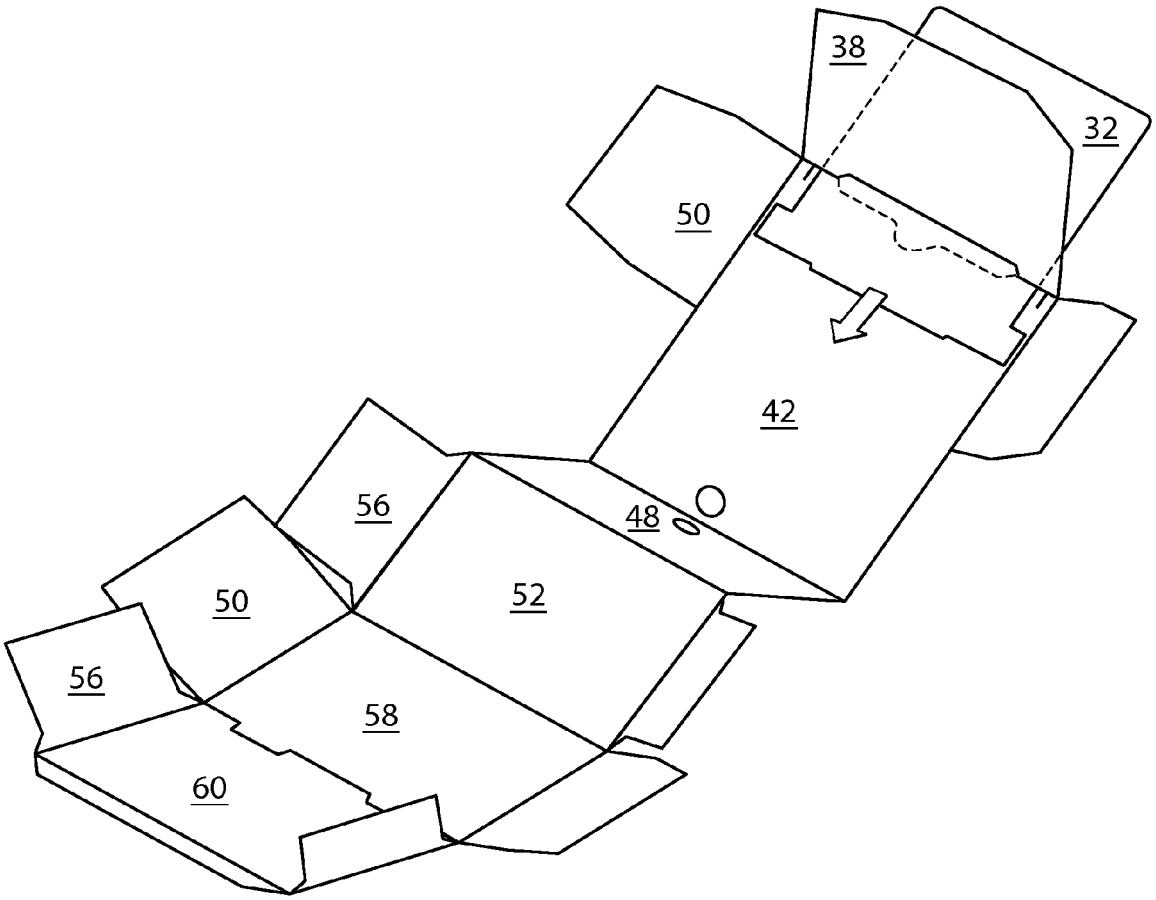
FIGS. 7-9 show various folding steps that are used to fold a blank into a foldable carton with a retractable panel.
Figure 8:
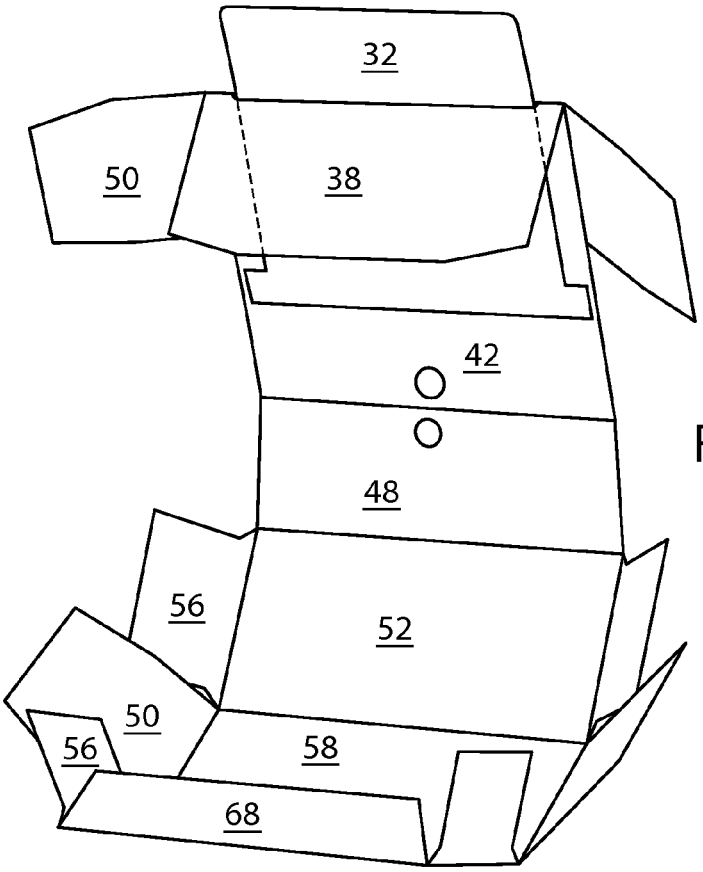
Figure 9:
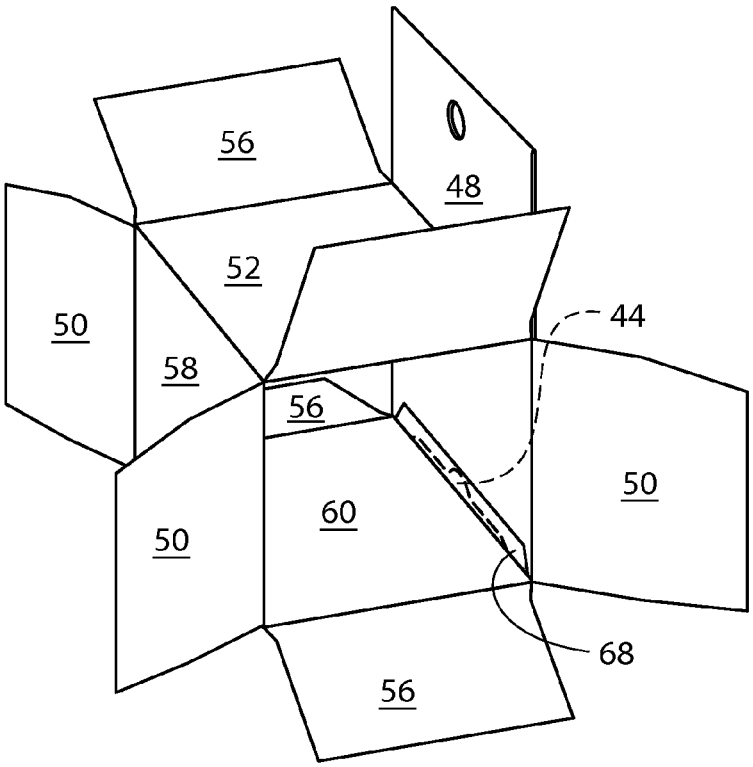

Foldably connected to the back panel 42 via another score line 40 is a face panel 48. As shown in the folding FIGS. 7-9, face panel 48 folds back over the back panel 42, such that the hanging feature 18' of the face panel 48 aligns with the hanging feature 18 of the back panel 42. Providing a back panel 42 and a face panel 48 that fold upon one another in use creates the visible back wall 14 of FIG. 3. This also allows only one side of the blank 30 to be printed or otherwise coated, with the other side left as raw, uncoated paperboard, saving manufacturing expense. Because these panels fold upon one another, only one side will show.

The next panel connected to the face panel 48 is a carton top panel 52, which forms the top portion 22 of the carton. Carton top panel 52 may be connected to the face panel 48 via a score line or via deeper perforations 54, which may ease the folding function and allow the carton top panel 52 to be folded at a right angle to the face panel 48. Extending from the carton top panel 52 are one or more side flap panels 56. Side flap panels 56 are shown as smaller than side flap panels 50 connected to the back panel 42, but they may be similarly sized or sized to be larger.

Foldably connected to the carton top panel 52 is carton front panel 58. Carton front panel 58 forms the front portion 24 of carton. Extending from the carton front panel 58 are one or more side flap panels 50, which are similarly shaped and sized to side flap panels 50 connected to the back panel 42, but they may be similarly sized, sized to be smaller, or sized to be larger.

Foldably connected to the carton front panel 58 is carton base panel 60. Carton base panel 60 forms the bottom portion 28 of carton. Extending from the carton base panel 60 are one or more side flap panels 56, which are similarly shaped and sized to side flap panels 56 connected to the carton top panel 52, but they may be similarly sized, sized to be smaller, or sized to be larger. In use, when the above described panels are folded and the side panels 50, 56 and folded in, the folded side panels 50, 56 collectively form side walls 26 of carton 10. The carton front panel 58 and carton base panel 60 are connected via a score line 40 that has cut areas 62 interposed therein. Cut areas are designed to assist with the folding of the carton, and they also provide two small feet 64 when the carton is assembled, as shown in FIG. 3. Front feet 64 can assist with the positioning of carton on a surface to counteract or balance the corresponding back feet 66 that may be created by the cut areas 46 between the securement flap 38 and the back panel 42, as shown in FIG. 1.

Foldably connected to the carton base panel 60 is a glue flap 68. In use, glue flap 68 folds back, up, and onto the securement panel 38, and is secured in place by a portion of glue. An additional portion of glue may be provided at a lower portion of the face panel 48 in order to allow the face panel 48 to adhere to the back panel 42 once folded.

The blank of FIG. 5 has similar features to the blank of FIG. 4, and it is folded similarly. As discussed above, the retractable panel 12 portion is provided as primary panel 32. The space 44 is shaped differently, and the hanging portions 18, 18' are shaped differently than the embodiment shown in FIG. 4. But the folding of the carton and the primary features remain.

The blank of FIG. 6 also had some differing features, but it is also folded similarly and the primary features remain.

Although various options have been shown on the various blanks of FIGS. 4-6, it should be understood that various retractable panels may be used with different blanks, that varying space 44 sizes may be provided, and that varying hanging options 18 may be provided. Simply because one option is shown in connection with a particular blank does not mean that it could not be used for other blanks, and such interchangeability is expected to be within the scope of one of ordinary skill in the art. For example, some embodiments may have a back panel that allows the carton to be hung from a shelf, some may not.

Changes and modifications, additions and deletions may be made to the structures and methods recited above and shown in the drawings without departing from the scope or spirit of the invention and the following claims.

What is claimed is:

1. A foldable carton with a retractable panel, comprising:

a carton blank that is cut and scored prior to being folded to form the carton, the carton blank comprising:

a retractable panel component comprising a printable panel with shoulder tabs;

a securement flap foldably connected to a back panel along a fold line, with an opening formed along the fold line between the securement flap and the back panel, the opening configured to receive the retractable panel in use, wherein when folded, the securement flap folds over the back panel to provide a housing into which the retractable panel is positioned in use;

a face panel foldably connected to the back panel, wherein when folded, the face panel folds over the back panel in order to provide a hanging tab, such that a first hanging feature on the back panel aligns with a second hanging feature on the face panel;

a carton top panel foldably connected to the face panel;

a carton front panel foldably connected to the carton top panel;

a carton base panel foldably connected to the carton front panel;

a glue flap panel foldably connected to the carton base panel, wherein the retractable panel extends from a lower portion of the back panel in use; and wherein the retractable panel is removeably connected to the securement flap.

2. The foldable carton of claim 1, further comprising at least one dust flap panel foldably connected to one or more of the carton top panel, the carton front panel, the carton base panel, or any combination thereof.

3. The foldable carton of claim 1, further comprising slight tabs on the carton face panel that create slight holes in the carton base panel during cutting of the blank, wherein a fold between the carton front panel and the carton base panel creates spaces.

4. The foldable carton of claim 1, wherein the retractable panel has shoulder tabs that secure it in the opening between the securement flap and the back panel.

5. A foldable carton with a retractable panel, comprising:

a carton blank that is cut and scored prior to being folded to form the carton, the carton blank comprising:

a retractable panel comprising a primary panel and a secondary panel;

a securement flap foldably connected to a back panel along a fold line, with an opening formed along the fold line between the securement flap and the back panel configured to receive the retractable panel in use; wherein when folded, the securement flap folds over the back panel to provide a housing into which the retractable panel is positioned in use;

a face panel foldably connected to the back panel, wherein when folded, the face panel folds over the back panel in order to provide a hanging tab, such that a first hanging feature on the back panel aligns with a second hanging feature on the face panel;

a carton top panel foldably connected to the face panel;

a carton front panel foldably connected to the carton top panel;

a carton base panel foldably connected to the carton front panel; and wherein the primary panel is connected to the securement flap and the retractable panel is positioned in the housing between the securement flap and the back panel.

6. The foldable carton of claim 5, wherein the retractable panel component extends from a lower portion of the back panel.

7. The foldable carton of claim 5, further comprising at least one dust flap panel foldably connected to one or more of the carton top panel, the carton front panel, the carton base panel, or any combination thereof.

* * * * *